United States Patent [19]

Luzzi et al.

[11] Patent Number: 4,891,016

[45] Date of Patent: Jan. 2, 1990

[54] 600-AMP HOT STICK-OPERABLE PIN-AND-SOCKET ASSEMBLED CONNECTOR SYSTEM

[75] Inventors: Glenn J. Luzzi, Mt. Bethel, Pa.; James E. Cole, Phillipsburg, N.J.

[73] Assignee: Amerace Corporation, Parsippany, N.J.

[21] Appl. No.: 329,972

[22] Filed: Mar. 29, 1989

[51] Int. Cl.[4] ..... H01R 13/53

[52] U.S. Cl. ..... 439/183; 439/372; 439/533; 439/921

[58] Field of Search ..... 439/533, 534, 535, 536, 439/540, 529, 370, 372, 183, 184, 185, 921

[56] References Cited

U.S. PATENT DOCUMENTS

| | | | |
|---|---|---|---|
| 3,323,097 | 5/1967 | Tordoff | 439/370 |
| 3,513,425 | 5/1970 | Arndt | 439/921 |
| 3,555,487 | 1/1971 | Jones | 439/521 X |
| 3,915,534 | 10/1975 | Yonkers | 439/183 X |
| 4,113,339 | 9/1978 | Eley | 435/183 |
| 4,170,394 | 10/1979 | Conway | 435/921 X |
| 4,773,872 | 9/1988 | Borgstrom et al. | 439/185 |
| 4,799,895 | 1/1989 | Borgstrom | 439/183 |
| 4,820,183 | 4/1989 | Knapp et al. | 439/372 X |

FOREIGN PATENT DOCUMENTS

| | | | |
|---|---|---|---|
| 1202855 | 10/1965 | Fed. Rep. of Germany | 439/347 |

*Primary Examiner*—William Briggs

*Attorney, Agent, or Firm*—David Teschner

[57] ABSTRACT

An apparatus bushing is fixed to a support wall or the wall of the apparatus housing and is electrically coupled to the apparatus within. A high voltage cable is fixed to the single leg of a 600-Amp "T" connector and is supported only by a bracket extending from said apparatus bushing to one of the "T" legs. A removable pin-and-socket applied link member selectively couples the remaining "T" leg to the apparatus bushing whereby power passes between the apparatus and high voltage cable only when said link is present and isolates said cable and apparatus when it is absent. A novel operating assembly assures proper contact between the link sockets and the pins of the apparatus bushing extender and the 600-Amp "T" connector and can be arranged to positively separate the link assembly. The operating assembly can also be used to install and remove a cap assembly when the electrical link is not in place.

15 Claims, 11 Drawing Sheets

600-AMP HOT STICK-OPERABLE PIN-AND-SOCKET ASSEMBLED CONNECTOR SYSTEM

BACKGROUND OF THE INVENTION

1. Field of the Invention

The invention is directed to the field of high voltage separable connector systems and more particularly to a 600-Amp stick-operable connector system used to interengage electrical apparatus with high voltage cable.

2. Description of the Prior Art

Proper maintenance procedures in high voltage systems involving transformers or switches and cable systems require that the system be de-energized and isolated by opening the switches at both ends of the cable run. The cable system is then tested to ascertain that it is actually de-energized and then each phase is grounded at both ends to prevent injury should the cable system become accidentally energized. Finally, the cables are removed from the switch or transformer bushings to achieve a visible break between the cables and their respective bushings.

A far simpler method for connecting and disconnecting transformers and switches with cable systems which did not require the physical movement of the 600-Amp cable to a parking station remote from its usual position and which still gave the required visual break which facilitated the testing and grounding of each phase was shown, described and claimed in U.S. Pat. No. 4,799,895, issued Jan. 24, 1989, entitled 600-Amp Hot Stick Operable Screw-Assembled Connector System by Alan D. Borgstrom and assigned to the assignee of the instant invention and by this reference incorporated herein as if the same were reproduced herein. The device of that patent uses a contact extender in each of its "T" shaped cable connectors and in the assembly of the bushing extender to the apparatus bushing into which the threaded studs of the link are screwed to assemble the link with the cable connector and bushing extender. Despite great care in the design to insure that all components are aligned before the link bolts are extended and threadably engaged with the contact extenders, some users fear that the link bolts and contact extenders can be cross threaded thereby preventing proper coupling and uncoupling of the link with the cable and apparatus bushing.

SUMMARY OF THE INVENTION

The present invention provides an alternative construction to that of the above-cited patent which preserves all of its highly desirable qualities while substituting a pin-and-socket coupling arrangement for the screw-operated features of the patent. In addition, a link-operating assembly is provided to insure proper assembly and disassembly of the link from the cable connector and apparatus bushing assembly.

To achieve this result, the bushing extender is fastened to the apparatus bushing which is fixed to a supporting member such as an apparatus wall by a fastener threaded at one end and with a mid-length annular shoulder thereabout that engages and holds the extender to the end of the apparatus bushing when the fastener is fully seated. The opposite end of the fastener is bored and the resulting cylinder wall segmented and shaped to form a bulbous, flexible contact surface. Alternatively, the opposite end may be retained as a solid cylinder with its leading end tapered.

A bracket is fixed about the apparatus bushing or the bushing extender from which to support the "T" shaped 600-Amp cable connector. The bracket is made up of a central member having a backing plate that will extend along the supporting member, an upper strap and a lower strap each of which extends perpendicular to the backing plate. Each strap has a central semi-circular recess proportioned to receive therein the bushing extender or a leg of the "T" connector flanked by apertured wings. A support member connects the deepest portions of the recesses and an additional aperture flanks such member. An upper band formed with a central recess and flanking apertured wings fits over the bushing extension enclosing it in combination with the recess of the upper strap. Fasteners through the aligned apertures of the upper strap and upper band lock the bracket to the apparatus bushing.

The "T" shaped 600-Amp cable connector with the cable coupled through its single leg is now brought to the bracket and placed in the lower strap recess. A lower band with semi-circular recess and flanked by apertured wings is now assembled to the lower strap by fasteners placed through the aligned apertures in the wings. The semi-circular recesses of the strap and band encircle and grasp one "T" leg of the connector and hold it aligned with the bushing extender without the need for a screw fastening as was true of the cited patent and without the need to fasten the cable connector to the support member.

The link can now be inserted or removed directly without the requirement that its components be screw operated. To properly engage with the pins of the bushing assembly or cable connector, sockets must be provided in the tubular housing metallic inserts. For the bulbous pin contact, a straight-walled socket with entry ring to compress the fingers may be provided and for the cylindrical pins, a straight-walled socket with one or more louvered contact rings which contact both socket walls and pin surface when the pins are inserted therein.

To insure proper joining of the pin-and-socket arrangements, an operating link assembly is employed. Mounted to the additional apertures in the back plate of the bracket are a pair of spaced-apart parallel members somewhat longer than the bushing extender. Adjacent their ends are parallel sidewall slots with an inclined rear face. The open ends of the slots are spanned by a roller sleeve. An operating handle is joined at each end to one of two spaced-apart parallel legs each of which has a curved slot adjacent its end and an outer surface of similar curvature. The curved slot is arranged to travel along the roller sleeve. A pushing band is pinned to the link and to the legs of the operating handle and about which the operating handle can pivot.

Seating of the link is achieved by engaging the curved slot with the roller sleeve and the link is advanced as the operating handle is rotated clockwise about the pivot pin advancing the slot along the roller sleeve and causing the pushing band and pins to push the link into place. Rotating the operating handle in the counter-clockwise direction causes the curved surfaces of the parallel legs to engage the inclined rear slot surfaces backing the parallel legs out and because of the pins connecting the legs with the link, disconnecting the link. Once the link is removed, a protected cap which may be operated by a mechanism similar to the operating link assembly may be used or push-in or snap-on caps may be used to seal the cable and bushing extender entrances and to prevent contact with the circuits. It is an object of this invention to provide a novel pin-and-socket interconnect system between a high voltage cable and an electrical apparatus.

It is another object of this invention to provide a novel interconnect system between a high voltage cable and an electrical apparatus which is achieved without moving the cable.

It is another object of this invention to provide a novel interconnect system between a high voltage cable and an electrical apparatus in which only the apparatus bushing is coupled to a support surface.

It is yet another object of this invention to provide a novel interconnect system between a high voltage cable and an electrical apparatus in which only the apparatus bushing is coupled to a support wall and the cable connector is supported by the apparatus bushing.

It is still another object of this invention to provide a novel interconnect system between a high voltage cable and an electrical apparatus employing pin-and-socket connections in a selectively-applied connecting link.

It is yet another object of this invention to provide a novel interconnect system between a high voltage cable and an electrical apparatus employing pin-and-socket connections and an external operating system to connect and disconnect a selectively-applied connecting link.

Other objects and features of the invention will be pointed out in the following description and claims and illustrated in the accompanying drawings which disclose, by way of example, the principles of the invention and the best modes which have been contemplated for carrying them out.

BRIEF DESCRIPTION OF THE DRAWING

In the drawings in which similar elements are given similar reference characters.

DESCRIPTION OF THE PREFERRED EMBODIMENTS

Figure 1:
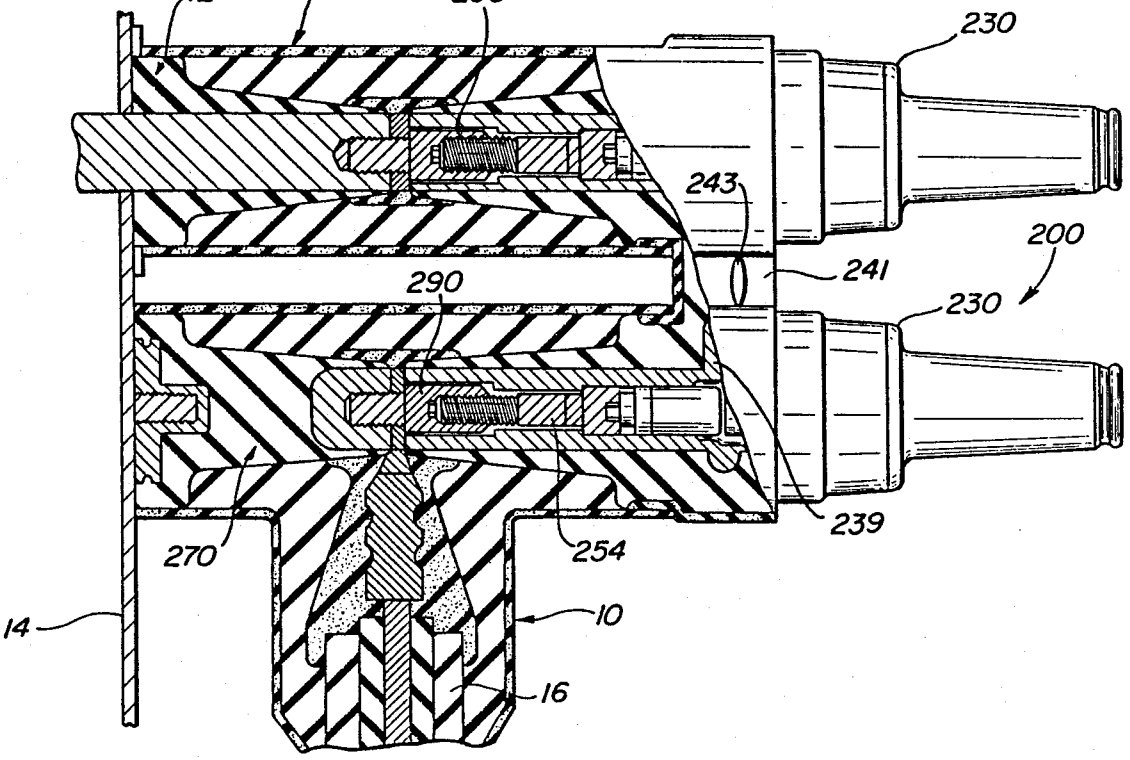
FIG-1 PRIOR ART
FIG. 1 is a fragmentary, side elevation, partially in section, showing a completed interconnect between a high voltage cable connected to a "T" connector and an apparatus bushing employing the bushing extender, contact extender and link assembly according to the concepts of the invention in (and is FIG. 10 of) the aforesaid Borgstrom patent, U.S. Pat. No. 4,799,895 issued Jan. 24, 1989.

Turning first to FIG. 1, the organization and operation of a cable-apparatus bushing interconnect system according to the above-cited prior-art patent is set forth.

Coupled to transformer wall 14 is an apparatus bushing 12 and in turn a bushing extender 300 is coupled to the conductor of the bushing 12 by contact extender 290 into which the bolt 254 of a first tap plug 230 is threaded. "T" connector 10 has a first "T" arm placed upon a dead-end insulator plug 270 which is coupled to the transformer wall 14. A contact extender 290 bolts the lug 22 of connector 20 of the high voltage cable 16 to the insulator plug 270 to support the "T" connector 10. Thus apparatus bushing 12 and "T" connector 10 are each self-supporting and each are connected to the transformer wall 14 independently. The high voltage cable 16 is then coupled to and uncoupled from the apparatus bushing 12 by use of link 200 as fully described in the above-identified '895 patent.

Figure 5:
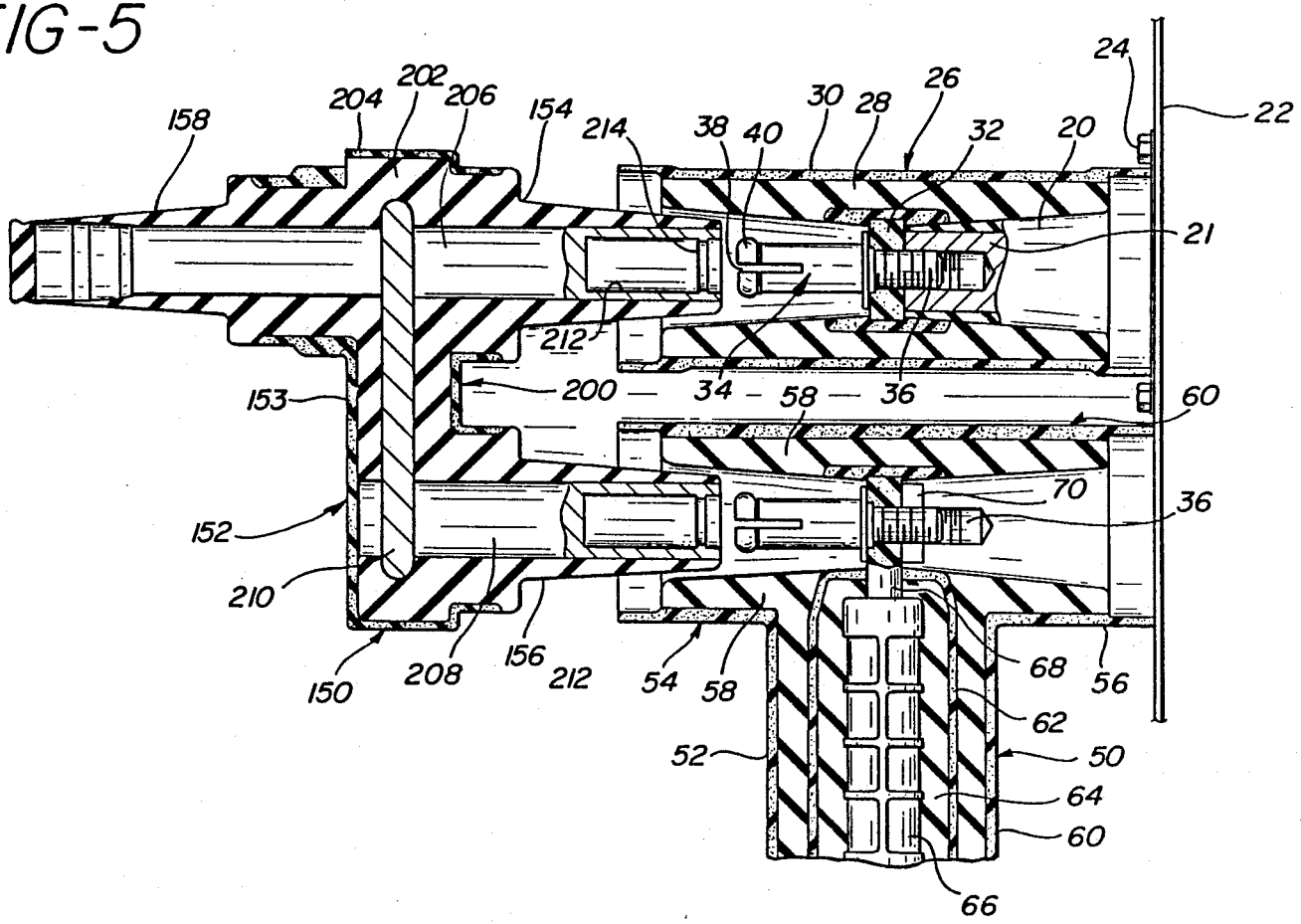
FIG. 5 is a fragmentary side elevational view, partially in section of an apparatus bushing, apparatus bushing extender having a first form of pin, high voltage cable connected to a "T" shaped connector and one form of interconnecting link prior to final assembly with the operating link assembly omitted so that the interior components can be viewed.

Turning now to FIG. 5, the organization of the instant invention can be contrasted with that described with respect to the '895 patent. An apparatus bushing 20 is bolted to support member 22 such as a transformer cabinet, equipment enclosure or the like by bolts 24. It could also be braised or welded or otherwise affixed thereto. A bushing extender 26 made of an insulating body sleeve 28 of insulating elastomeric covered by a conductive sleeve 30 of semi-conductive elastomeric is coupled to the conductor 21 within apparatus bushing 20 by the threaded end 36 of plug 34 engaging central plug 32 of the extender 26 and forcing it against the face of the apparatus bushing 12 thereby assembling bushing extender 26 to support member 22.

Figure 10:
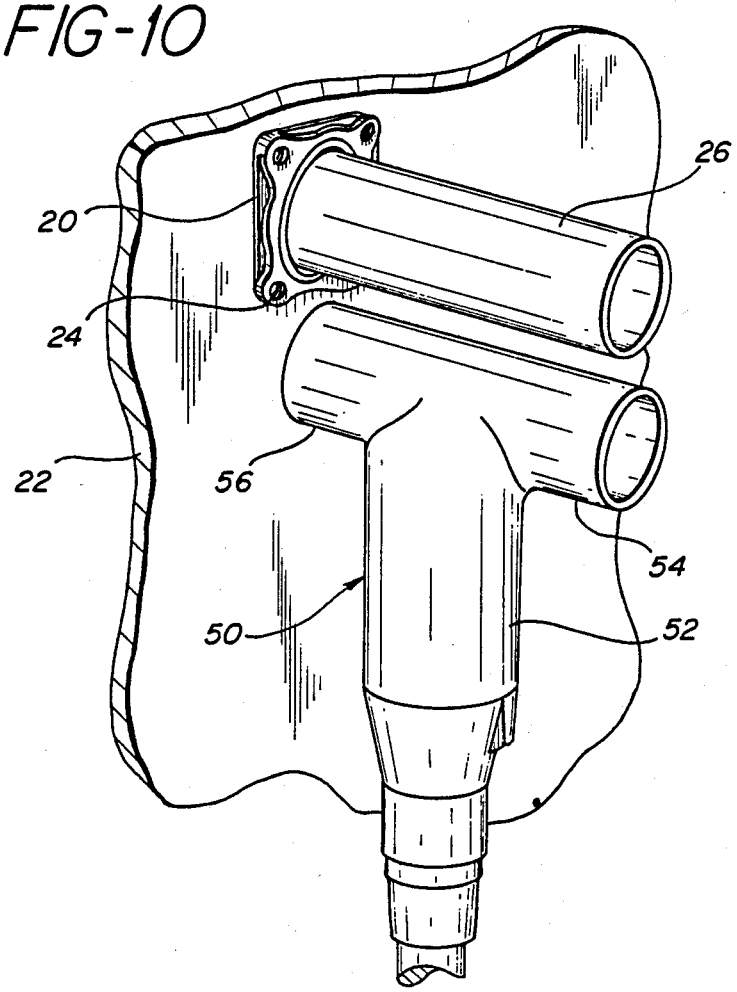
FIG. 10 is a front perspective view of an apparatus bushing mounted to a support member, a bushing extender mounted to the bushing and a "T" shaped connector placed adjacent the bushing and bushing extender showing them both to be of generally the same length.

No insulator plug is provided for the "T" shaped connector 50. "T" shaped connector 50 has a single leg 52 and two, in-line "T" legs 54 and 56. The entire body is generally made of an insulating elastomeric shell 58 over which is placed a conductive elastomeric sleeve 60. A further internal shield of conductive elastomeric material 62 and insulative elastomeric 64 surround the metallic cable connector 66 which terminates in a threaded lug 68 bolted to insert 70 molded into the housing 58 by the threaded end 36 of plug 34. The end of the "T" arm 56 rests against but is not fastened to the support member 22 in the relative positions shown by the members in FIG. 10 and is held in that position by the bracket to be described below.

Figure 11:
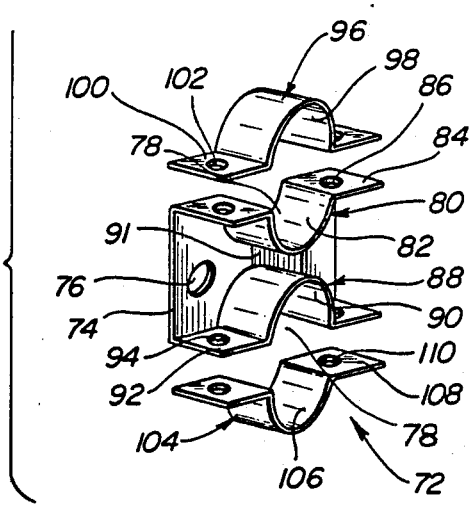
FIG. 11 is an exploded, front perspective view of the support bracket of FIG. 2.
Figure 12:
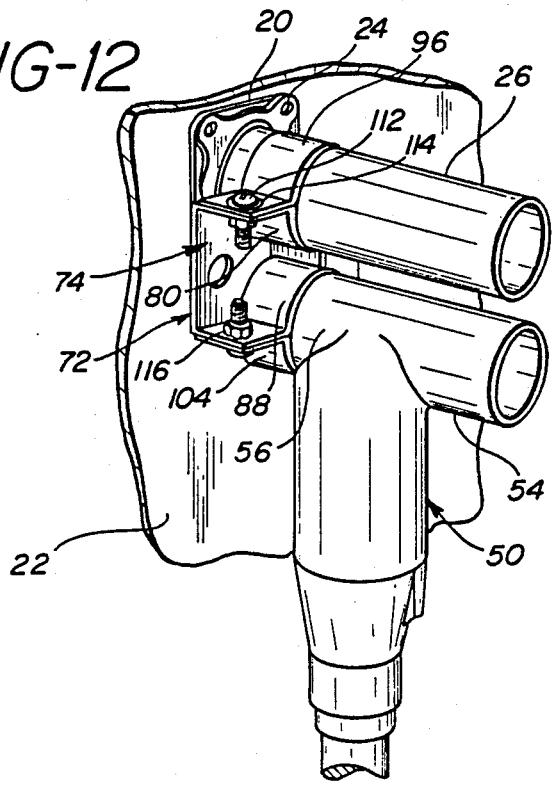
FIG. 12 is a front perspective view of the elements of FIG. 10 interconnected by the assembled support bracket of FIG. 11.

Referring now to FIGS. 11 and 12, the bracket 72 for holding the apparatus bushing extender 26 and the "T" shaped cable connector 50 together is shown. A backplate 74 has an aperture 76 to each side of its center line (only one is shown in the figure) and semi-circular recesses 78 along the center line, the top one opening to the top marginal edge of backplate 74 and the bottom one opening to the bottom marginal edge. A top strap 80 has a semi-circular recess 82 aligned with the upper recess in backplate 74 and flanking wings 84 aligned with the top marginal edge of backplate 74. Each wing 84 contains an aperture 86. Similarly, a bottom strap 88 has a semi-circular recess 90 aligned with the lower recess in backplate 74 and flanking wings 92 aligned with the bottom marginal edge of backplate 74. Each wing 92 contains an aperture 94. A strengthening plate 91 joins straps 80 and 88 at their recesses 82 and 90.

An upper band 96 has a central semi-circular recess 98 which, together with recess 82, can substantially, fully encompass the perimeter of an apparatus bushing 20 or an apparatus bushing extender 26. Band 96 has flanking wings 100 with apertures 102 which can receive fasteners (see FIG. 12) to unite band 96 with strap 80. A lower band 104 has a central semi-circular recess 106 which, together with recess 90, can substantially, fully encompass the perimeter of "T" leg (either 56 or 54) of connector 50. Band 104 has flanking wings 108 with apertures 110 which can receive fasteners to unite band 88 with strap 102.

As shown in FIG. 12, an apparatus bushing 20 is fastened to support member or transformer wall 22 by fasteners 24. A bushing extender 26 is attached by pins such as 34 (see FIG. 5) (not shown). Bracket 72 is attached to extender 26 by a pair of fasteners 112 using flat washers 114 and nuts 116 to fastener strap 80 and band 96 about extender 26. "T" shaped connector 50 is gripped and positioned by strap 88 and band 104 about "T" leg 56 held in place by a similar pair of fasteners 112, flat washers 114 and nuts 116.

Figure 13:
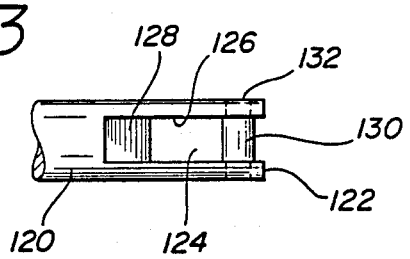
FIG. 13 is a fragmentary top view of the end of a member of the operating link assembly of FIG. 2 showing a construction detail.
Figure 14:
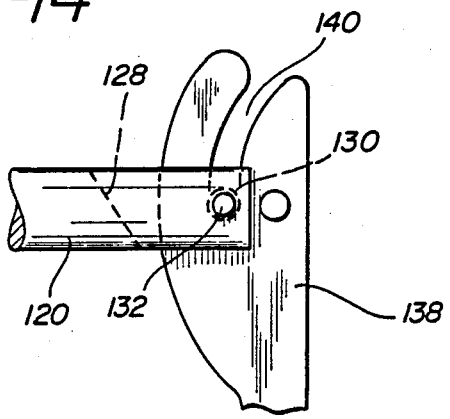
FIG. 14 is a fragmentary side elevation of the end of a member and arm of the operating link assembly of FIG. 2 showing construction details thereof in the operated condition.
Figure 15:
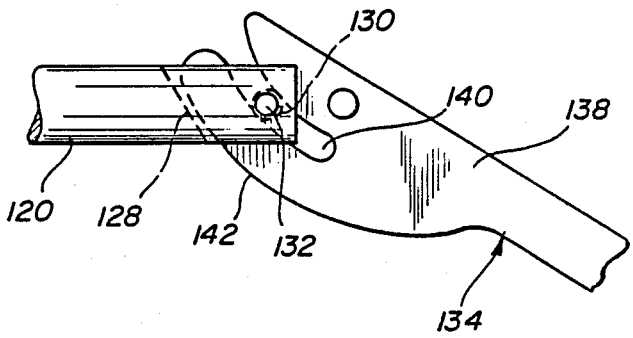
FIG. 15 is a fragmentary side elevation of the end of a member and arm of the operating link assembly of FIG. 2 showing construction details thereof in the separation phase.

Fastened by fasteners (not shown) from behind backplate 74 through apertures 76 are a pair of members 120 (see FIG. 3) which extend in parallel with bushing extender 26. At the front ends 122 of the members 120 are slots 124 having straight, parallel sides 126 and an inclined rear face 128 (FIGS. 13 to 15). Spanning each of the slots 124 is a roller sleeve 130 mounted upon a pin 132.

Link operating system 134 (see FIG. 3) is made up of an operating handle 136 from which extend at each end arms 138. Adjacent the free ends of each of the arms 138 is a curved slot 140 dimensioned to pass along the outside of roller sleeve 130. The outer edge 142 of free ends of each of the arms 138 is curved to ride along the inclined rear face 128 of slot 124 of member 120 as will be described below.

Figure 4:
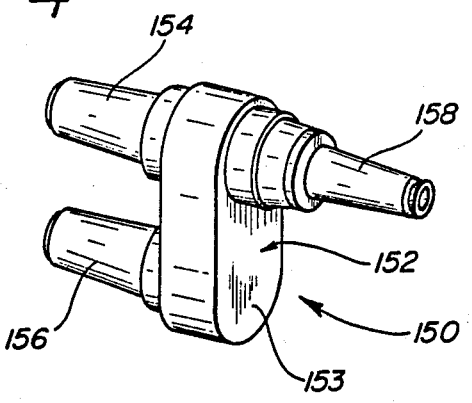
FIG. 4 is a front perspective view of the interconnecting link of FIG. 1.

Pushing arm 144 is pinned by pin 146 to arms 138 on each side and to the link 150. Operating handle 136 is free to rotate about pins 146. Link 150 (see FIG. 4) has a central body position 152 with a front face 153 and two frusto-conically shaped legs 154, to mate respectively with the bushing extender 26, and 156 to mate with "T" arm 54. A third frusto-conically shaped leg 158 extends in the opposite direction to that of legs 154, 156.

Figure 2:
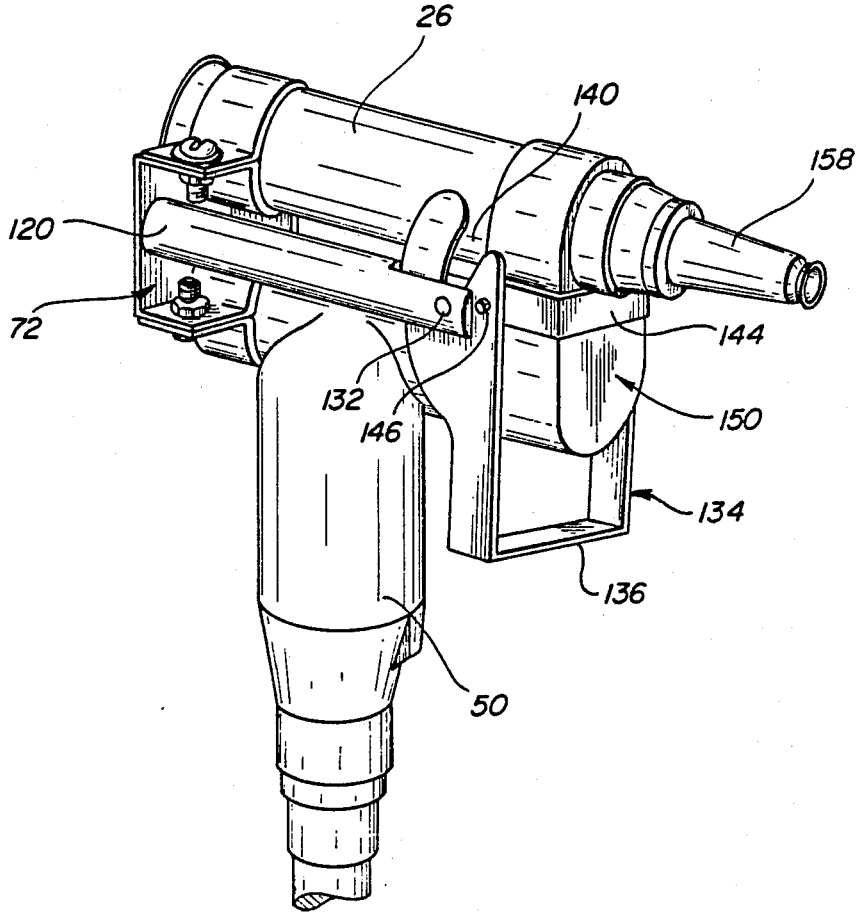
FIG. 2 is a front perspective view of a completed interconnect between a high voltage cable connected to a "T" shaped connector, an apparatus bushing extender, support bracket and operating link assembly constructed in accordance with the concepts of the instant invention.
Figure 3:
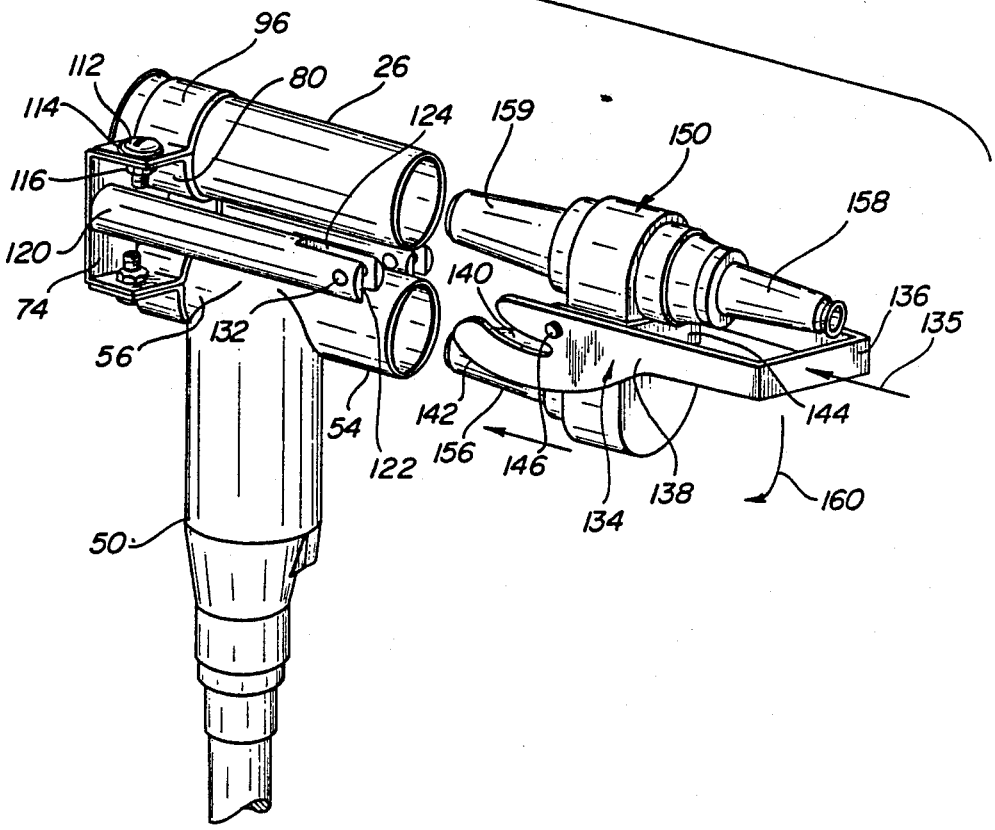
FIG. 3 is an exploded view of the components of FIG. 2 with the operating link assembly separated from the "T" shaped connector and apparatus bushing extender.

To engage the link 150 with bushing extender 26 and "T" connector 50, the link operating system 134 is aligned as shown in FIG. 3. The system 134 is moved to the left in the direction of the arrow 135 with a hot stick or other appropriate insulated tool (not shown) until leg 154 enters the bushing extender 26, leg 156 enters "T" leg 54 and roller sleeve 130 enters slot 140. Operating handle 136 is then rotated by the aforementioned tool in the direction of arrow 160 about pivot pin 146 advancing the slot 140 along sleeve 130 and fully seating legs 154 and 156 by the combined effects of pushing arm 144 and pins 146. The completed assembly of link 150 is shown in FIG. 2.

Figure 9:
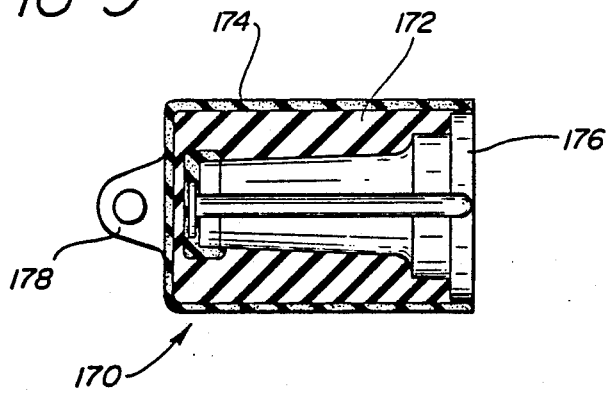
FIG. 9 is a side elevation, in section, of a cap for the tap plug free end.

As was described in the '895 patent, leg 158 can be used to test the system and ground same using the tools described therein. To seal leg 158, a cap 170 as shown in FIG. 9 and well known in the art may be employed. Cap 170 has a insulative elastomeric body 172 covered with a conductive elastomeric layer 174. A first end 176 is open and the entry is stepped to mate with the ribs of the tap plug leg 158. The closed end has a pulling eye 178 which is engaged by a hot stick or other appropriate tool to install or remove same.

To remove the link 150, the operating handle 136 (using an appropriate tool) is rotated in a direction opposite to that shown by arrow 160. As arms 138 rotate about pins 146, the curved surfaces 142 of arms 138 ride the inclined faces 128 of slots 124 of members 120 and the effect is to urge the arms 138 out of engagement with roller sleeves 130 promoting separation. The continued pulling of link operating system 134 in the direction opposite that of arrow 135 separates link 150 from the bushing extender 26 and "T" arm 54 as is shown in FIG. 3.

Figure 16:
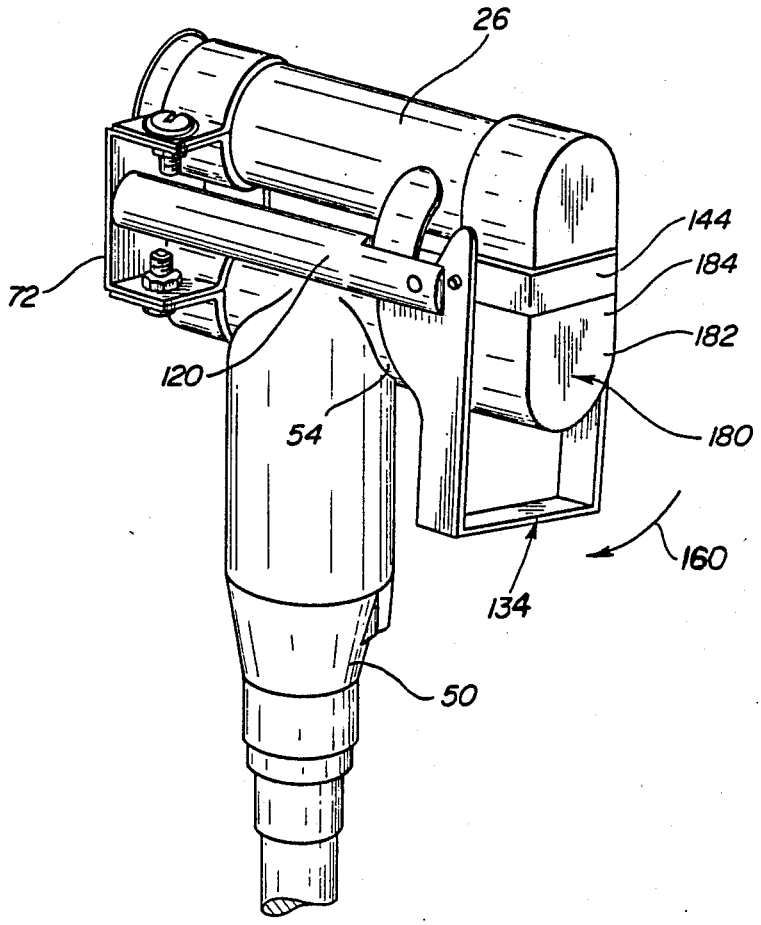
FIG. 16 is a frant perspective view of the arrangement of FIG. 1 with a dummy plug in position of the operating link assembly.

So as not to leave exposed cable and bushing entrances, an insulating cap 180 as shown in FIG. 16 may be employed. Cap 180 is similar to link 150 in general appearance except it omits any frusto-conically shaped leg protruding from the front face 184 of the main body 182, such as 158 in FIG. 4, and although it has two frusto-conically shaped legs to mate with extender 26 and "T" leg 54, there are no electrical components therein. The cap 180 is installed and removed by a link-operating system 134 of the type described above with respect to FIGS. 2 and 3 operating also in the manner described.

Figure 17:
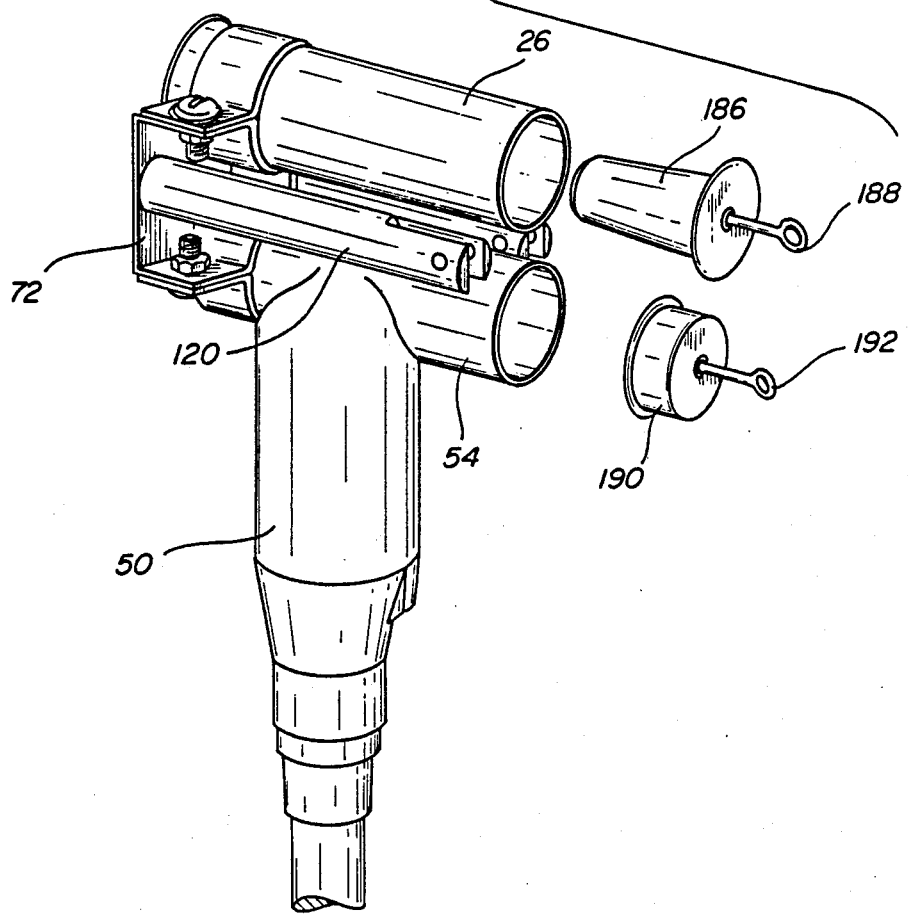
FIG. 17 is an exploded front perspective view of the arrangement of FIG. 1 with the operating link assembly removed and alternate forms of end caps positioned adjacent the open ends of the "T" shaped connector and the bushing extension.

Alternatively, FIG. 17 shows two further caps. Cap 186 takes the shape of a bushing that may be press-fit into the interior of the bushing extender 26 or "T" leg 54. A pulling eye 188 permits installation and removal of cap 186. Cap 190 is intended for application to the external surface of extender 26 or "T" leg 54 also by use of an appropriate tool applied to pulling eye 192.

Returning to FIG. 5, link 150 will now be described in greater detail. A central body 152 of insulating elastomeric 202 has molded to it at selected locations a layer of conductive elastomeric 204. From central body portion 152, projects a frusto-conically shaped leg 158 which contains a central metal tube 206 through which tools may be inserted, as described in the '895 patent to test the line and ground same. Extending from a rear face 200 are a pair of frusto-conically shaped legs 154 and 156. Leg 156 also contains a metallic tube 208 joined to tube 206 by a buss bar 210 housed in central body portion 152.

Figure 6:
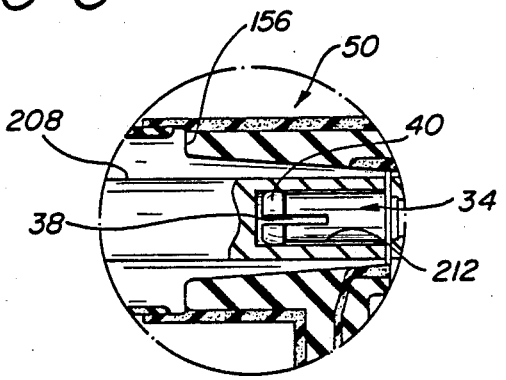
FIG. 6 is a fragmentary side elevation, partly in section, of the pin-and-socket arrangement of FIG. 5 fully engaged.

Formed at the free ends of each of the tubes 206 and 208 is a socket 212 proportioned to receive therein the segmented bulbous end 40 of plug 34. An annular ring 214 on the interior wall of the sockets 212 adjacent the entrance thereto prevents the unwanted removal of the plugs 34 from sockets 212 once the link 150 is assembled to extender 26 and "T" arm 54. The link operating system 134, omitted for the sake of simplicity, holds the components together. The plug 34 fully seated in socket 212 is shown in FIG. 6.

Figure 8:
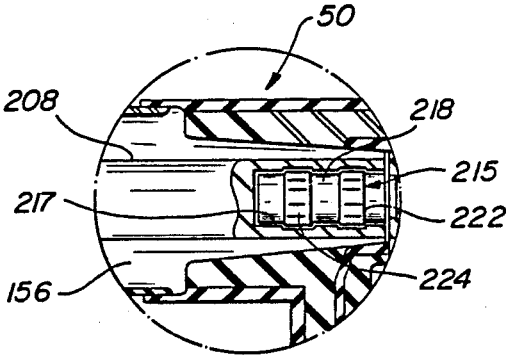
FIG. 8 is a fragmentary side elevation, partially in section, of the pin-and-socket arrangement of FIG. 7 fully engaged.
Figure 7:
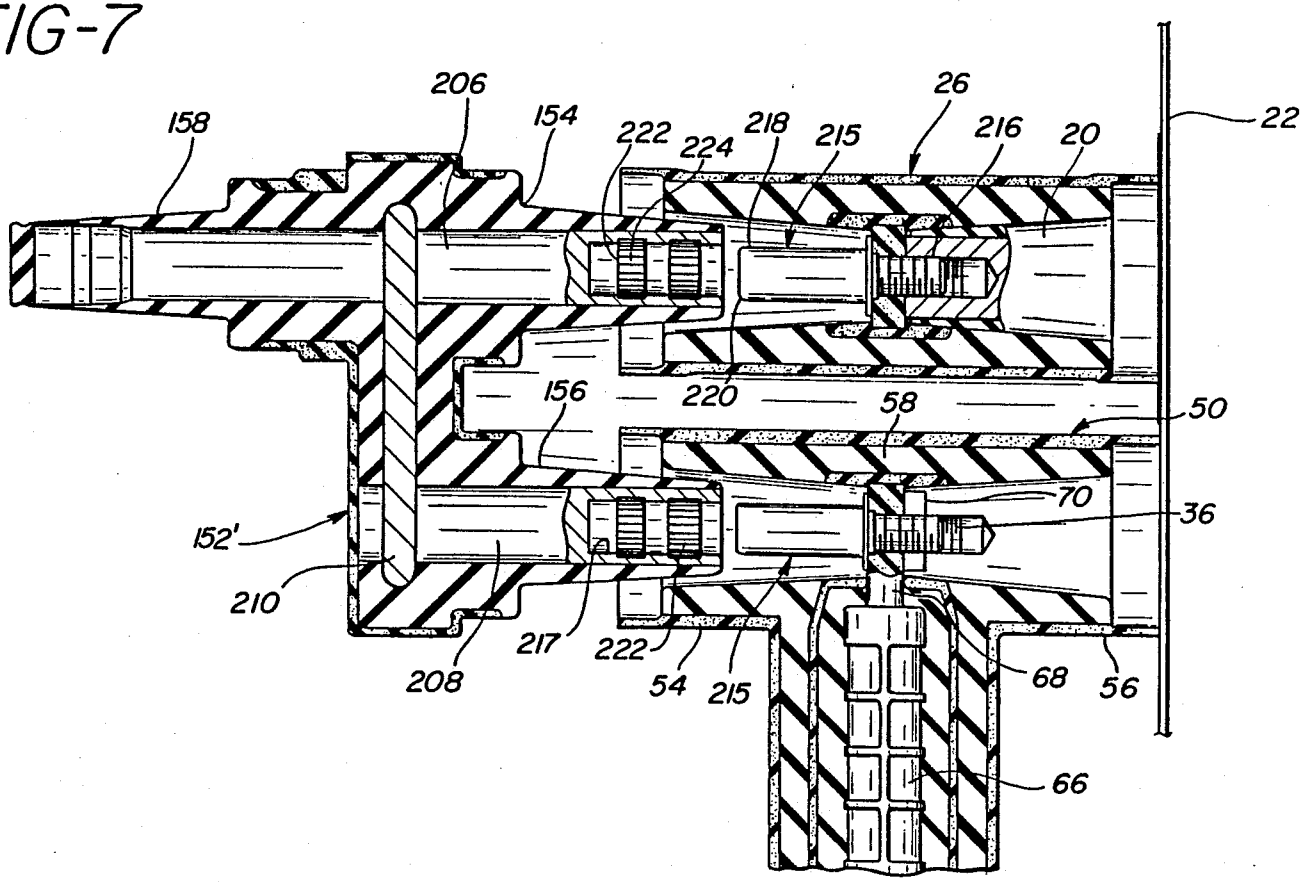
FIG. 7 is a fragmentary side elevational view, partially in section, of an apparatus bushing, apparatus bushing extender having a second form of pin, high voltage cable connected to a "T" shaped connector and a second form of interconnecting link, prior to final assembly, with the operating link assembly omitted so that the interior components can be viewed.

FIGS. 7 and 8 show an alternative pin-and-socket approach. Plug 215 has a threaded rear portion 216 which is threadably engaged with the threaded aperture of the bushing 20 to unite bushing extender 26 to the bushing 20. A smooth, cylindrical contact portion 218, tapered at the leading edge, as at 220, projects into the bore of extender 26. A similar plug 215 is threadably engaged with the threaded aperture in insert 70 molded into the housing 58.

Link 152' is similar to link 152 except that the sockets 217 have unobtruded smooth side walls. Placed in the sockets are one or more louvered rings 222 of the type fully disclosed in U.S. Pat. No. 4,186,985 issued Feb. 5, 1980, entitled Electrical Connector, by Frank M. Stepniak and Andrew A. Kominiak and assigned to the assignee of the instant invention. The louvered rings 222 have slats 224 which deflect as the contact portions 218 enter to make contact with the outer surface of the contact portions 218 and the inner surface of the sockets 217 to make an electrical contact therebetween as shown in FIG. 8. Again, the link-operating system 134 has been omitted so that the details of the improvements can be appreciated.

While two forms of pin-and-socket connector have been shown, many other forms of pin-and-socket can be used as long as they are easily and positively connectable and disconnectable and can carry sufficient current.

While there have been shown and described and pointed out the fundamental novel features of the invention as applied to the preferred embodiment, it will be understood that various omissions and substitutions and changes of the form and details of the devices illustrated and in their operation may be made by those skilled in the art without departing from the spirit of the invention.

The embodiments of the invention in which an exclusive property or privilege is claimed are defined as follows:

1. A high voltage hot-stick operable pin-and-socket assembled connector system for selectively coupling together a source of high voltage and a high voltage cable comprising:

a support member;

an apparatus bushing mounted upon said support member and electrically coupled to a source of high voltage;

a high voltage cable;

bracket means coupled between said apparatus bushing and said high voltage cable to position said cable with respect to said apparatus bushing;

selectively applicable pin-and-socket operated link member when applied n a first arrangement joining said apparatus bushing to said cable to apply high voltage thereto or when not applied between said apparatus bushing and said cable, providing a visible separation between said bushing and said cable;

said pin-and-socket operated link means comprising a first and a second housing assembly each containg a metallic insert, one of said first and said second housing assemblies pin-and socket coupled to said apparatus bushing and the other pin-and-socket coupled to said high voltage cable;

a conductive metal buss coupling said metallic inserts of said first and said second housing assemblies and a lever-operating system for selectively applying said link member in said first arrangement and for withdrawing said link member from such application.

2. A connection system as defined in claim 1 wherein said bracket means comprises:

a central portion having an upper band portion formed with a central semi-circular recess arranged to receive a portion of said apparatus bushing flanked by outwardly extending wings each containing an aperture and a lower band portion formed with a central semi-circular recess arranged to receive a portion of said high voltage cable flanked by outwardly extending wings each containing an aperture;

an upper strap formed with a central semi-circular recess to receive a portion of said apparatus bushing flanked by outwardly extending wings each containing an aperture aligned with the corresponding apertures in the wings of said upper band portion;

first fastening means extending through the corresponding apertures of said extending wings of said upper strap and said upper band portion which when tightened substantially engage the surface of said apparatus bushing and fix said bracket means thereto.

3. A connection system as defined in claim 2, further comprising:

an upper strap formed with a central semi-circular recess to receive a portion of said high voltage cable flanked by outwardly extending wings each containing an aperture aligned with the corresponding apertures in the wings of said lower-hand portion;

second fastening means extending through the corresponding apertures of said extending wings of said lower strap and said lower-hand portion which when tightened substantially engage the surface of said high voltage cable and fix said bracket means thereto.

4. A connector system as defined in claim 1, wherein said high voltage cable is terminated to the single leg of a "T" shaped connector and contact extender means is coupled to said apparatus bushing to present free interfaces for said link means an equal distance from said support member.

5. A connector system as defined in claim 1, wherein said lever operating system comprises two spaced-apart, parallel members extending in parallel and to either side of the "T" leg of said "T" shaped connector and a cross means engageable with said parallel members and said link means properly seat said link means.

6. A conector system as defined in claim 5, wherein said cross member is coupled to said link means by a pivotal pin means whereby movememt of said cross member in a first direction seats said link means and movement of said cross member in a second direction withdraws said link means.

7. A connector system as defined in claim 5 wherein the free ends of said parallel members are slotted and the slots are spanned by a pin supported roller sleeve and said cross means has an extension at each end containing a curved slot adjacent its free end to engage and move along said roller sleeve of said parallel members to seat said link means as said roller sleeves advance along said curved slots.

8. A connector system as defined in claim 5 wherein the free ends of said parallel members are slotted and the back wall of said slots are inclined to the longitudinal axis of said parallel members and each of said slots are spanned by a pin-supported roller sleeve and said cross means has an operating bar with parallel arms extending from the ends thereof each containing a curved slot adjacent its free end to engage and move along said roller sleeve of said parallel members;

a pushing bar coupled to said parallel arms;

a pivot pin coupled to said pushing bar and said link means about which said parallel arms are free to rotate;

said parallel arms having a curved outer surface parallel with said curved slot;

said movement of said curved slot along said roller sleeve as said operating bar is moved in a first direction causing said link means to properly seat and said movement of the curved outer surface of said parallel arms with the back walls of said slots causing said link means to be withdrawn.

9. A connector system as defined in claim 1, wherein said link means contains no metal insert and no metal buss bar and when applied to said apparatus bushing and high voltage cable merely seals the ends thereof.

10. A connector system as defined in claim 4, wherein said contact extender means is coupled to said apparatus bushing by a fastener having a pin projecting towards the open end thereof and said cable is coupled to said single leg of said "T" shaped connector by an additional fastener having a pin projecting toward the open end of one of said "T" legs of said connector;

said metallic inserts each having a free end remote from said conductive metal buss, said free ends each containing a socket for receipt and engagement with one of the pins of said fastener and said additional fastener.

11. A connector system as defined in claim 10, wherein each of said pins is split into at least four segments and the outer surface adjacent the ends thereof is bulbous to increase the contact with its corresponding socket.

12. A connector system as defined in claim 10, wherein each of said pins is a smooth uniform diameter cylinder with a tapered leading edge.

13. A connector system as defined in claim 11, wherein each of said sockets has an interior annular ring adjacent the open end of said sockets.

14. A connector system as defined in claim 12, wherein each socket has at least one louvered contact ring lining the inner surface of said socket to make simultaneous contact with the interior surface of said socket and the exterior surface of said corresponding pin when said pins are inserted in said corresponding sockets.

15. A connector system as defined in claim 1, further comprising caps to cover the open ends of bushing and said cable when said link means is not applied to avoid tampering or entry into said apparatus bushing and high voltage cable.

* * * * *